United States Patent [19]

Partridge

[11] 4,266,300

[45] May 12, 1981

[54] ATTACHABLE AND DETACHABLE POCKET FOR A GARMENT

[76] Inventor: Aileen A. Partridge, 2018 W. Superior St., Apt. 4, Duluth, Minn. 55806

[21] Appl. No.: 61,948

[22] Filed: Jul. 30, 1979

[51] Int. Cl.[3] ..... A41D 27/20

[52] U.S. Cl. ..... 2/247

[58] Field of Search ..... 2/247-254

[56] References Cited

U.S. PATENT DOCUMENTS

| | | | |
|---|---|---|---|
| 1,764,483 | 6/1930 | Watkins | 2/247 |
| 3,398,439 | 8/1968 | Fried et al. | 24/7 |
| 3,611,444 | 10/1971 | Rector | 2/247 |
| 3,624,686 | 11/1971 | Beals | 2/48 |

*Primary Examiner*—Doris L. Troutman

*Attorney, Agent, or Firm*—Wicks & Nemer

[57] ABSTRACT

An attachable and detachable pocket for a garment including a flat back portion having a front portion secured thereto together with a panel connected to the upper portion of the back portion with a portion thereof extended beyond the back portion. The extended portion has a pressure sensitive adhesive surface and a releasable cover member for said pressure sensitive adhesive surface.

2 Claims, 5 Drawing Figures

ATTACHABLE AND DETACHABLE POCKET FOR A GARMENT

SUMMARY

The invention relates to pockets on a garmet and more particularly to a pocket which may be quickly and easily attached to and detached from a garmet such as a ladies or childrens blouse or pants as examples. Many pants and blouses and the like come without pockets, and in many situations pockets are handy and sometimes very necessary.

It is an object of the invention to provide a very inexpensive pocket which is attachable to a garmet and removable when desired. The pocket may be made in various sizes and shapes and may be used for keys, change, cigarettes, matches, and the like which it is not practical to carry when a garmet worn does not have a pocket. The pocket can be made of plastic and therefore disposable and in various sizes and asssorted colors.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
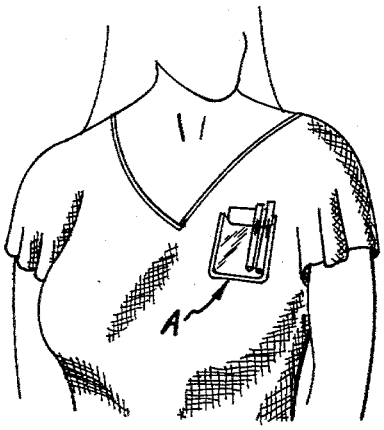
FIG. 1 is a perspective view of an auxiliary attachable and detachable pocket for a garmet shown attached to a blouse and embodying the invention.
Figure 2:
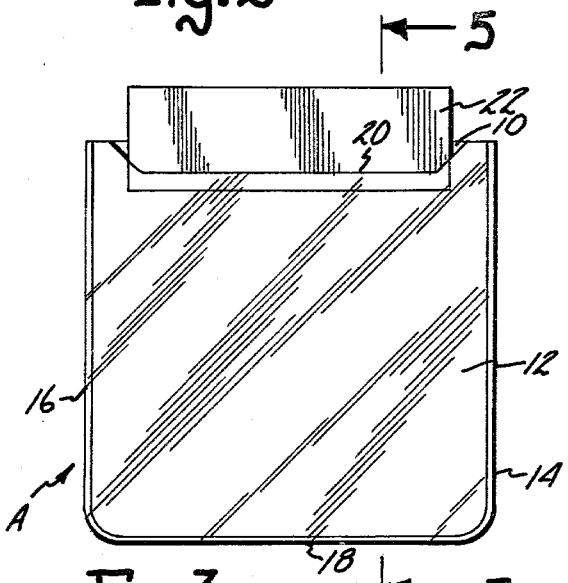
FIG. 2 is a front longitudinal view of the device.
Figure 3:
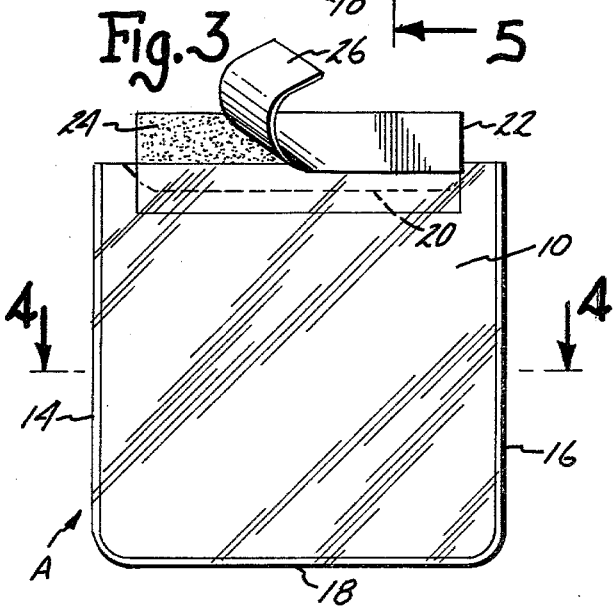
FIG. 3 is a rear longitudinal view thereof.
Figure 5:
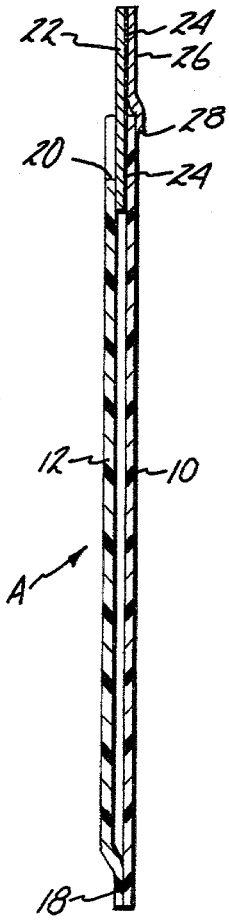
FIG. 5 is a sectional view on the line 5—5 of FIG. 2.
Figure 4:
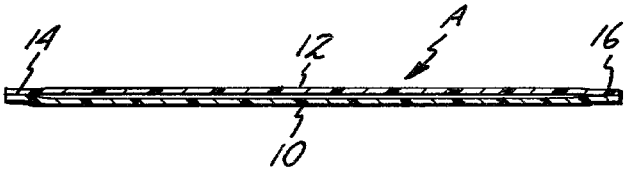
FIG. 4 is a sectional view on the line 4—4 of FIG. 3.

Referring to the drawings in detail, the auxiliary attachable and detachable pocket A includes the plastic flat back portion 10 which has secured to the front flat surface thereof the plastic flat front portion 12 by means of heat sealing of the side edges as at 14, 16 and the bottom edges as at 18. The front and back portions may also be sewed together. The front portion 12 has the recess 20 formed therein at the top edge which allows easier access into the pocket formed by the front and back portions with open top end.

The numeral 22 designates a panel which has pressure sensitive adhesive 24 on the rear surface thereof whereby the same is secured at the lower half of its vertical dimension to the front flat surface of the rear pocket portion. The upper-half of the adhesive 24 on the panel 22 is covered by the protective flat strip 26 the lower edge of which extends slightly over the top edge of the back portion 10 as at 28.

The length of the panel 22 is less than the width of the front and back portions so that it can be secured to the back portion and extended within the pocket and behind the front pocket portion. The pocket A may also be made from sheet cloth, leather or the like.

In using the pocket A the protective strip 26 is removed from the adhesive 24 on the back of the panel 22, and then the panel 22 pressed upon a garment with the adhesive 24 engaging the garment. With the pocket held only at the top end thereof with the lower portion handing freely it facilitates the placing of articles in the pocket. The pocket may be easily removed from the garment by simply pulling on the panel portion away from the garment whereby the adhesive releases from the garment. The pocket may be used again and the pocket may be easily decorated on the front portion 12. Further the pocket lends itself to the use of various colored material.

Having thus described the invention, what is claimed as new and desired to be secured by Letters Patent is:

1. An attachable and detachable pocket for a garmet comprising:

(a) a back portion, (b) a front portion secured to said back portion along the sides and bottom and open at one end to form a pocket, (c) a single panel having a pressure sensitive adhesive surface on the rear thereof for the sole connection with a garment, a portion thereof adhesively connected to the upper front portion of said back portion with the outer portion thereof extended beyond said back portion, (d) said other portion of said single panel having (e) means for protecting said pressure sensitive adhesive surface of said other portion prior to exposure of the adhesive surface for securing the pocket to a garment by pressing the exposed pressure sensitive area of the extended portion directly upon a garment.

2. The device of claim 1 in which said means for pro ecting said pressure sensitive adhesive surface includes a flat strip engageable upon the adhesive surface.

* * * * *